US007428872B2

(12) United States Patent
Strong et al.

(10) Patent No.: US 7,428,872 B2
(45) **Date of Patent: *Sep. 30, 2008**

(54) FRAME FOR A TABLE TOP

(75) Inventors: L. Curtis Strong, Clearfield, UT (US); Jacob Kearl, Plain City, UT (US); Joel Bennett, Clinton, UT (US); Edward G. VanNimwegen, North Ogden, UT (US); Carl R. Stanford, Clinton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 219 days.

This patent is subject to a terminal disclaimer.

(21) Appl. No.: 11/141,528

(22) Filed: May 31, 2005

(65) Prior Publication Data

US 2005/0279259 A1 Dec. 22, 2005

Related U.S. Application Data

(63) Continuation-in-part of application No. 10/408,917, filed on Apr. 8, 2003, now Pat. No. 7,100,518, application No. 11/141,528, which is a continuation-in-part of application No. 10/964,096, filed on Oct. 13, 2004, now Pat. No. 6,915,748, which is a continuation of application No. 10/216,342, filed on Aug. 10, 2002, now Pat. No. 6,848,370, which is a continuation of application No. 09/635,303, filed on Aug. 9, 2000, now Pat. No. 6,431,092, which is a continuation-in-part of application No. 09/228,326, filed on Jan. 11, 1999, now Pat. No. 6,112,674.

(60) Provisional application No. 60/576,505, filed on Jun. 2, 2004, provisional application No. 60/588,853, filed on Jul. 15, 2004, provisional application No. 60/371,486, filed on Apr. 9, 2002.

(51) Int. Cl.
*A47B 3/00* (2006.01)

(52) U.S. Cl. ..... 108/132; 108/132; 108/161

(58) Field of Classification Search ..... 108/132, 108/129, 131, 130, 133; 248/439, 88.6
See application file for complete search history.

(56) References Cited

U.S. PATENT DOCUMENTS

| | | | |
|---|---|---|---|
| 236,197 | A | 1/1881 | Valley |
| 236,741 | A | 1/1881 | Weaver |
| 769,354 | A | 9/1904 | Mielsen |
| 1,063,642 | A | 6/1913 | Birdsall |
| 1,165,991 | A | 12/1915 | Maggs |
| 1,266,929 | A | 5/1918 | Enis |
| 1,272,187 | A | 7/1918 | Basford |

(Continued)

FOREIGN PATENT DOCUMENTS

| | | |
|---|---|---|
| AU | 223700 | 5/1958 |

(Continued)

*Primary Examiner*—José V Chen
(74) *Attorney, Agent, or Firm*—Workman Nydegger

(57) ABSTRACT

A table may include a table top and one or more legs and the legs may be movable between an extended or use position and a collapsed or storage position. The table may include one or more cross bars and the legs may be attached to the cross bars. The table may also include a frame and the frame may include one or more side rails. The cross bars may be sized and configured to engage at least a portion of the table frame with a generally rigid connection when the legs are in the extended position and a loose connection with the legs are in the collapsed position. In addition, the table may include one or more connecting members that may be disposed towards the ends of the table. Advantageously, the connecting members and/or cross bars may securely support the table top and help prevent the table top from undesirably twisting or deforming if a load or force is applied to a portion of the table top.

20 Claims, 4 Drawing Sheets

U.S. PATENT DOCUMENTS

| | | | |
|---|---|---|---|
| 1,296,336 | A | 3/1919 | Stine |
| 1,351,013 | A | 8/1920 | Stine |
| 1,514,418 | A | 11/1924 | Battenfeld |
| 1,594,572 | A | 8/1926 | Soltesz |
| 1,659,840 | A | 2/1928 | Smith |
| 1,757,260 | A | 5/1930 | Silverman |
| 1,765,766 | A | 6/1930 | Lyon |
| 1,823,484 | A | 9/1931 | Blumenthal |
| 1,836,843 | A | 12/1931 | Temple |
| 1,836,934 | A | 12/1931 | Morecroft |
| 1,888,117 | A | 11/1932 | Fox |
| 1,956,946 | A | 5/1934 | Duffy |
| 2,109,869 | A | 3/1938 | Ross |
| 2,257,550 | A | 9/1941 | Gay |
| 2,278,810 | A | 4/1942 | Virtue |
| 2,326,461 | A | 8/1943 | Howe |
| 2,411,658 | A | 11/1946 | La Rue |
| 2,452,169 | A | 10/1948 | Wells |
| 2,470,869 | A | 5/1949 | Schmidt |
| 2,512,473 | A | 6/1950 | Alch |
| 2,522,642 | A | 9/1950 | Schmidt |
| 2,524,198 | A | 10/1950 | La Rue |
| 2,548,682 | A | 4/1951 | Price |
| 2,558,465 | A | 6/1951 | Seymour |
| 2,568,622 | A | 9/1951 | Hagan |
| 2,579,924 | A | 12/1951 | Krasney |
| 2,583,247 | A | 1/1952 | Aja et al. |
| 2,621,710 | A | 12/1952 | Miller |
| 2,647,562 | A | 8/1953 | Hoffar |
| 2,661,792 | A | 12/1953 | Lysaght |
| 2,670,031 | A | 2/1954 | Melges |
| 2,689,158 | A | 9/1954 | Mahr |
| 2,690,210 | A | 9/1954 | Holick |
| 2,717,028 | A | 9/1955 | Villemune |
| 2,717,631 | A | 9/1955 | Howe |
| 2,722,971 | A | 11/1955 | Gallagher et al. |
| 2,748,837 | A | 6/1956 | Beller |
| 2,752,987 | A | 7/1956 | Smithers |
| 2,756,082 | A | 7/1956 | Pucci |
| 2,766,812 | A | 10/1956 | Schrader |
| 2,771,937 | A | 11/1956 | Wilson |
| 2,780,506 | A | 2/1957 | Howe |
| 2,788,059 | A | 4/1957 | Mackintosh |
| 2,800,379 | A | 7/1957 | Smithers |
| 2,805,708 | A | 8/1957 | Bohn |
| 2,811,197 | A | 10/1957 | Nimmo |
| 2,811,400 | A | 10/1957 | James |
| 2,825,390 | A | 3/1958 | Post |
| 2,831,688 | A | 4/1958 | Knox |
| 2,837,141 | A | 6/1958 | Shore |
| 2,849,053 | A | 8/1958 | Beller et al. |
| 2,878,589 | A | 3/1959 | Howe et al. |
| 2,936,820 | A | 5/1960 | Blink et al. |
| 2,939,516 | A | 6/1960 | Drew |
| 2,959,209 | A | 11/1960 | Lakin |
| 2,964,368 | A | 12/1960 | Heyer |
| 2,978,754 | A | 4/1961 | Wilson |
| 2,983,308 | A | 5/1961 | Horowitz |
| 2,992,043 | A | 7/1961 | Nelson |
| 2,999,729 | A | 9/1961 | Semmelroth |
| 3,025,120 | A | 3/1962 | Howe |
| 3,027,209 | A | 3/1962 | Nielsen |
| 3,030,728 | A | 3/1962 | Wesman |
| 3,041,775 | A | 7/1962 | Brown, Jr. et al. |
| 3,079,197 | A | 2/1963 | Mugler |
| 3,080,193 | A | 3/1963 | Nimmo |
| 3,093,924 | A | 6/1963 | Pompa |
| 3,096,866 | A | 7/1963 | Glass |
| 3,101,062 | A | 8/1963 | Kanzelberger |
| 3,112,954 | A | 12/1963 | Kanitz |
| 3,141,424 | A | 7/1964 | Seymour |
| 3,143,982 | A | 8/1964 | Blink et al. |
| 3,144,236 | A | 8/1964 | Clanin |
| 3,166,029 | A | 1/1965 | Acton |
| 3,174,796 | A | 3/1965 | Brown |
| 3,191,991 | A | 6/1965 | Anderson et al. |
| 3,256,037 | A | 6/1966 | Giambalvo |
| 3,259,426 | A | 7/1966 | Shaw et al. |
| 3,267,886 | A | 8/1966 | Glass |
| 3,273,936 | A | 9/1966 | Deavers |
| 3,276,815 | A | 10/1966 | Cardy |
| 3,337,262 | A | 8/1967 | Katzfey et al. |
| 3,349,728 | A | 10/1967 | Barecki et al. |
| 3,353,867 | A | 11/1967 | Anderson |
| 3,357,729 | A | 12/1967 | Krueger |
| 3,410,232 | A | 11/1968 | Krueger |
| 3,429,283 | A | 2/1969 | Uhor |
| 3,439,634 | A | 4/1969 | Bender |
| 3,545,738 | A | 12/1970 | Stagg |
| 3,574,393 | A | 4/1971 | Hughes |
| 3,580,632 | A | 5/1971 | Seymour |
| 3,635,432 | A | 1/1972 | Hollander |
| 3,650,560 | A | 3/1972 | Wohlk |
| 3,672,719 | A | 6/1972 | Haukedahl |
| 3,692,358 | A | 9/1972 | Sung |
| 3,718,306 | A | 2/1973 | Murray |
| 3,731,971 | A | 5/1973 | Siogren |
| 3,762,626 | A | 10/1973 | Dorsey |
| 3,765,719 | A | 10/1973 | Silver |
| 3,769,920 | A | 11/1973 | Weiss |
| 3,788,696 | A | 1/1974 | Loewen |
| 3,797,884 | A | 3/1974 | Gutierrez |
| 3,857,343 | A | 12/1974 | Greenberg |
| 3,885,829 | A | 5/1975 | Haeger |
| 3,893,400 | A | 7/1975 | Grant |
| 3,905,478 | A | 9/1975 | Peterson et al. |
| 3,922,408 | A | 11/1975 | Smith |
| 3,960,354 | A | 6/1976 | Simikoski |
| 3,994,527 | A | 11/1976 | Nikitits et al. |
| 4,040,658 | A | 8/1977 | Mayol |
| 4,043,277 | A | 8/1977 | Wallace |
| 4,047,754 | A | 9/1977 | Cathey |
| 4,052,100 | A | 10/1977 | Nikitits et al. |
| 4,060,275 | A | 11/1977 | Hansen |
| 4,064,812 | A | 12/1977 | Commanda |
| 4,064,815 | A | 12/1977 | Baum |
| 4,070,057 | A | 1/1978 | Jones |
| 4,072,231 | A | 2/1978 | Helms |
| 4,111,482 | A | 9/1978 | Jones |
| 4,131,311 | A | 12/1978 | Nikitits et al. |
| 4,157,089 | A | 6/1979 | Loughrey |
| 4,191,111 | A | 3/1980 | Emmert |
| RE30,274 | E | 5/1980 | Bolon et al. |
| 4,249,773 | A | 2/1981 | Giambalvo |
| 4,289,350 | A | 9/1981 | Thomas et al. |
| 4,330,151 | A | 5/1982 | Healey |
| 4,382,627 | A | 5/1983 | Dean |
| 4,415,199 | A | 11/1983 | Wright |
| 4,438,603 | A | 3/1984 | Durkan, Jr. |
| 4,462,636 | A | 7/1984 | Markson |
| 4,471,969 | A | 9/1984 | Zabala et al. |
| 4,489,661 | A | 12/1984 | Fitzgerald |
| 4,537,443 | A | 8/1985 | Bray |
| 4,538,526 | A | 9/1985 | Seeley |
| 4,557,200 | A | 12/1985 | Geschwender |
| 4,572,574 | A | 2/1986 | Fischhaber et al. |
| 4,596,196 | A | 6/1986 | Gunter et al. |
| 4,606,575 | A | 8/1986 | Kodet |
| 4,648,652 | A | 3/1987 | Van Kuren |
| 4,653,804 | A | 3/1987 | Yoo et al. |
| 4,700,987 | A | 10/1987 | Sraka et al. |
| 4,740,032 | A | 4/1988 | Olsen et al. |
| 4,744,309 | A | 5/1988 | Kiesel et al. |
| 4,759,296 | A | 7/1988 | Simpson |

| | | | |
|---|---|---|---|
| 4,762,321 | A | 8/1988 | Chang |
| 4,815,394 | A | 3/1989 | Ettlinger et al. |
| 4,817,902 | A | 4/1989 | Mason |
| 4,822,066 | A | 4/1989 | Rehrig |
| 4,826,244 | A | 5/1989 | Choi |
| 4,834,450 | A | 5/1989 | Stickler |
| 4,838,180 | A | 6/1989 | Gutgsell |
| 4,841,877 | A | 6/1989 | Virtue |
| 4,841,879 | A | 6/1989 | Ferguson |
| 4,864,941 | A | 9/1989 | Goulter |
| 4,883,314 | A | 11/1989 | Sakong |
| 4,903,686 | A | 2/1990 | Jennings |
| 4,951,576 | A | 8/1990 | Cobos et al. |
| 4,960,303 | A | 10/1990 | York |
| 4,998,395 | A | 3/1991 | Bezner |
| 5,007,673 | A | 4/1991 | Cheng |
| 5,009,170 | A | 4/1991 | Spehar |
| 5,014,628 | A | 5/1991 | Roberts |
| 5,018,785 | A | 5/1991 | Monson et al. |
| 5,029,938 | A | 7/1991 | Song |
| 5,060,902 | A | 10/1991 | Hartman |
| 5,070,664 | A | 12/1991 | Groh et al. |
| 5,109,778 | A | 5/1992 | Berkowitz et al. |
| 5,149,575 | A | 9/1992 | Soifer |
| 5,208,084 | A | 5/1993 | Rutz |
| 5,217,125 | A | 6/1993 | Swanson |
| 5,240,307 | A | 8/1993 | Jones et al. |
| 5,271,338 | A | 12/1993 | Bonham |
| 5,279,233 | A | 1/1994 | Cox |
| 5,284,100 | A | 2/1994 | Thorn |
| 5,314,231 | A | 5/1994 | Otterbacher |
| 5,323,713 | A | 6/1994 | Luyk et al. |
| 5,325,793 | A | 7/1994 | Martin |
| 5,335,594 | A | 8/1994 | Karlyn et al. |
| D350,862 | S | 9/1994 | Beller |
| 5,345,881 | A | 9/1994 | Loescher |
| 5,357,872 | A | 10/1994 | Wilmore |
| 5,377,601 | A | 1/1995 | Cashen |
| 5,394,808 | A | 3/1995 | Dutro et al. |
| 5,409,245 | A | 4/1995 | Kern et al. |
| 5,411,314 | A | 5/1995 | Wallace |
| 5,421,272 | A | 6/1995 | Wilmore |
| 5,440,857 | A | 8/1995 | Shanok et al. |
| 5,443,020 | A | 8/1995 | Price |
| 5,483,901 | A | 1/1996 | Tisbo et al. |
| 5,488,926 | A | 2/1996 | Hunt |
| 5,490,467 | A | 2/1996 | Diffrient |
| 5,505,142 | A | 4/1996 | Fink |
| 5,528,997 | A | 6/1996 | Miller |
| 5,536,552 | A | 7/1996 | Scripsick |
| 5,622,120 | A | 4/1997 | Yeh |
| 5,623,882 | A | 4/1997 | Price |
| 5,626,339 | A | 5/1997 | Schickert et al. |
| 5,636,578 | A | 6/1997 | Rizzi |
| 5,638,761 | A | 6/1997 | Berkowitz et al. |
| 5,678,491 | A | 10/1997 | Price et al. |
| 5,694,865 | A | 12/1997 | Raab |
| 5,730,066 | A | 3/1998 | Auten et al. |
| 5,732,637 | A | 3/1998 | Raab |
| 5,860,367 | A | 1/1999 | Riegel et al. |
| 5,865,128 | A | 2/1999 | Tarnay |
| 5,868,081 | A | 2/1999 | Raab |
| 5,889,148 | A | 3/1999 | Lee et al. |
| 5,899,148 | A | 5/1999 | Buono |
| 5,909,021 | A | 6/1999 | Duffy |
| 5,921,623 | A | 7/1999 | Nye et al. |
| 5,947,037 | A | 9/1999 | Hornberger et al. |
| D414,626 | S | 10/1999 | Collins et al. |
| 5,983,807 | A | 11/1999 | Tarnay et al. |
| 5,984,047 | A | 11/1999 | Rogers |
| 6,000,345 | A | 12/1999 | Gillotti |
| D419,332 | S | 1/2000 | Collins et al. |
| D420,527 | S | 2/2000 | Pinch et al. |
| 6,032,585 | A | 3/2000 | Pinch |
| D423,258 | S | 4/2000 | Pinch |
| 6,058,853 | A | 5/2000 | Pinch |
| 6,058,854 | A | 5/2000 | Tarnay et al. |
| 6,076,472 | A | 6/2000 | Lloyd |
| 6,086,148 | A | 7/2000 | Gatto et al. |
| 6,109,687 | A | 8/2000 | Nye et al. |
| 6,112,674 | A | 9/2000 | Stanford |
| D442,788 | S | 5/2001 | Nye et al. |
| 6,334,400 | B1 | 1/2002 | Nien |
| 6,347,831 | B1 | 2/2002 | Nye et al. |
| 6,371,034 | B1 | 4/2002 | Simpson et al. |
| 6,431,092 | B1 | 8/2002 | Stanford |
| 6,530,331 | B2 | 3/2003 | Stanford |
| 6,550,404 | B2 | 4/2003 | Stanford |
| 6,615,743 | B2 | 9/2003 | Nien |
| 6,622,644 | B2 | 9/2003 | Buono |
| 6,651,568 | B1 | 11/2003 | Buono |
| 6,655,301 | B2 | 12/2003 | Stanford |
| D489,557 | S | 5/2004 | Strong et al. |
| 6,732,663 | B2 | 5/2004 | Tsai |
| 6,823,806 | B1 | 11/2004 | Buono |
| 6,832,563 | B2 | 12/2004 | Stanford |
| 6,848,370 | B1 | 2/2005 | Stanford |
| 6,895,872 | B2 | 5/2005 | Stanford |
| 6,915,748 | B2 | 7/2005 | Stanford |
| 2003/0005864 | A1 | 1/2003 | Wen |
| 2003/0106474 | A1 | 6/2003 | Buono |
| 2003/0127028 | A1 | 7/2003 | Baik et al. |
| 2003/0177962 | A1 | 9/2003 | Stanford |
| 2003/0233967 | A1 | 12/2003 | Lin |
| 2004/0031422 | A1 | 2/2004 | Wong |
| 2004/0099189 | A1 | 5/2004 | Stanford |
| 2004/0187747 | A1 | 9/2004 | Shenghao et al. |
| 2004/0187748 | A1 | 9/2004 | Shenghao et al. |
| 2004/0194675 | A1 | 10/2004 | Shenghao et al. |
| 2004/0237856 | A1 | 12/2004 | Shenghao et al. |
| 2004/0244656 | A1 | 12/2004 | Shenghao et al. |
| 2005/0045075 | A1 | 3/2005 | Stanford |
| 2005/0045076 | A1 | 3/2005 | Stanford |

FOREIGN PATENT DOCUMENTS

| | | |
|---|---|---|
| BE | 650758 | 11/1964 |
| CA | 2166651 | 7/1996 |
| DE | 341007 | 5/1920 |
| DE | 3705566 | 9/1988 |
| EP | 0572331 | 12/1933 |
| FR | 2553644 | 4/1985 |
| FR | 2637474 | 4/1990 |
| GB | 10007 | 5/1908 |
| GB | 1457271 | 12/1976 |
| GB | 1595210 | 8/1981 |
| JP | 09065934 | 3/1997 |
| JP | H10-75825 | 3/1998 |
| TW | 320006 | 3/1997 |
| WO | WO 95/10204 | 4/1995 |

FRAME FOR A TABLE TOP

CROSS-REFERENCE TO RELATED APPLICATIONS

This application claims priority to and the benefit of U.S. provisional patent application No. 60/576,505, filed Jun. 2, 2004.

This application also claims priority and the benefit of U.S. provisional patent application No. 60/588,853, filed Jul. 15, 2004.

This application is also a continuation-in-part of U.S. patent application Ser. No. 10/408,917, filed Apr. 8, 2003, now U.S. Pat. No. 7,100,518; which claims priority to and the benefit of U.S. provisional patent application Ser. No. 60/371,486, filed Apr. 9, 2002.

This application is also a continuation-in-part of U.S. patent application Ser. No. 10/964,096, filed Oct. 13, 2004, now U.S. Pat. No. 6,915,748; which is a continuation of U.S. patent application Ser. No. 10/216,342, filed Aug. 10, 2002, now U.S. Pat. No. 6,848,370; which is a continuation of U.S. patent application Ser. No. 09/635,303, filed Aug. 9, 2000, now U.S. Pat. No. 6,431,092; which is a continuation-in-part of U.S. patent application Ser. No. 09/228,326, filed Jan. 11, 1999, now U.S. Pat. No. 6,112,674.

Each of these applications and patents are incorporated by reference in their entirety.

BACKGROUND OF THE INVENTION

1. Field of the Invention

The present invention is generally related to tables and, in particular, to a frame for a table top.

2. Description of Related Art

Conventional tables typically include one or more legs that are connected to a table top. Many conventional tables include folding legs to allow the table to be more easily transported and stored. In particular, conventional tables often include legs that are pivotally attached to the table top to allow the legs to be moved between an extended position in which the legs extend outwardly from the table top and a collapsed or storage position in which the legs are positioned near or adjacent to the table top. Thus, when the table is desired to be used, the legs can be placed in the extended position. On the other hand, when the table is desired to be transported or stored, the legs can be placed in the collapsed or storage position.

The table tops of many conventional tables with folding legs are frequently constructed from materials such as metal or wood. In particular, these known table tops may be constructed from steel, aluminum, plywood, particle board, fiber board and other types of wooden laminates. Conventional table tops constructed from wood or metal, however, are often relatively heavy and this may make the table awkward or difficult to move. Table tops constructed from wood or metal are also relatively expensive and the table tops must generally be treated or finished before use. For example, conventional table tops constructed from wood are often sanded and/or painted, and table tops constructed from metal must be formed or cut into the desired shape and painted or otherwise finished. In addition, some wooden table tops include a vinyl or protective covering, which may undesirably increase the cost of the table and make the table more difficult to repair if damaged.

Conventional table tops constructed from materials such as plywood, particle board, fiber board or wooden laminates are often not very strong or rigid. These known types of tables often cannot support large or heavy items, and these types of tables generally cannot withstand large forces or impacts without breaking or cracking. For example, these types of wooden table tops may split, shatter or the legs may become disconnected.

In addition, conventional tables with table tops constructed from wood or metal may be relatively heavy, which makes the table more difficult to move and more expensive to ship and transport. In order to decrease the weight of these known tables, the table tops can be constructed from lightweight materials such as plastic. For example, it is known to construct table tops from injection molded plastic to form relatively thin, lightweight table tops. Disadvantageously, these relatively thin, lightweight table tops constructed from injection molded plastic are often relatively fragile and unable to support a large amount of force or weight. Consequently, many injection molded plastic table tops require reinforcing members or other structural parts, such as brackets or support members, to strengthen the table top. In addition, the injection molded table tops may include support beams or channels that are intended to increase the strength of the table top. While these additional parts and features may increase the strength of the table top, they may undesirably increase the weight and bulkiness of the table. In addition, these additional parts may increase manufacturing costs and require additional time to assemble the table. Further, these additional parts may increase complexity and limit the functionality of the table.

It is also known to construct table tops from other materials and processes to create relatively thin, lightweight table top. Many conventional table tops constructed from relatively thin, light-weight materials lack the strength and sturdiness of the heavier-weight tables. For example, known table tops constructed from relatively thin, lightweight materials may undesirably twist or be distorted if an uneven load or force is applied to a portion of the table top. In particular, if a large load or force is applied to one corner of the table top, the table top may undesirably bow, bend, twist or otherwise deform.

BRIEF SUMMARY OF EMBODIMENTS OF THE INVENTION

A need therefore exists for a table that eliminates or diminishes the above-described disadvantages and problems.

One aspect is a table that may include one or more legs or leg assemblies that can be moved between an extended or use position and a collapsed or storage position. When the legs are in the extended or use position, then the legs may support a table top above a surface such as the floor. On the other hand, when the legs are in the collapsed or storage position, then the table may be easier to move and/or transport.

Another aspect is a table that may include a frame. The frame may be attached to the table top and the frame may be sized and configured to support the table top and/or allow the legs to be attached to the table top. For example, the frame may include one or more side rails and one or more cross bars may be connected to the side rails of the frame. The legs may be connected to the cross bars and the cross bars may be pivotally or otherwise connected to the table frame, which may facilitate movement of the legs between the extended and the collapsed positions.

A further aspect is a table that may allow a component to be connected in a relatively loose or movable position in one configuration and a tight or secure connection in another configuration. For example, the table may include a frame with side rails and a cross bar may be connected to the side rails by disposing the ends of the cross bar in openings in the side rails. When the cross bar is in a first configuration, the cross bar is loosely connected to the frame so that the cross bar can wobble or move slightly relative to the frame. On the other hand, when the cross bar is in the second configuration, the cross bar is tightly and securely connected to the side rails of the frame. Advantageously, if the legs are attached to the cross bar, then the legs may be loosely or movably connected to the frame in the first configuration and securely connected to the frame in the second configuration. Thus, for example, when the legs are in the collapsed position, then the legs may be loosely or movably connected to the frame. In contrast, when the legs are in the extended position, then the legs may be securely connected to the frame.

Another further aspect is the openings in the side rails of the frame may include one or more engaging portions that allow the cross bar to be loosely or securely connected to the frame. For example, the engaging portions of the openings in the side rail may be sized and configured to engage one or more portions of the cross bars when the legs are in the extended position to secure the legs in a generally fixed position. The one or more engaging portions may also sized and configured to at least partially disengage one or more portions of the cross bars when the legs are in the collapsed position to loosely connect the legs to the frame.

A still further aspect is the cross bars may include one or more engaging portions that allow the cross bar to be loosely or securely connected to the frame. The engaging portions of the cross bars may be sized and configured to engage one or more portions of the openings in the side rails when the legs are in the extended position to secure the legs in a generally fixed position. The one or more engaging portions may also be sized and configured to at least partially disengage one or more portions of the openings in the side rails when the legs are in the collapsed position to loosely connect the legs to the frame.

Advantageously, with the cross bars rigidly and securely attached to the side rails of the frame, the legs preferably do not shake or wobble. This may facilitate construction of a strong and sturdy table. In addition, when the cross bars are rigidly and securely attached to the frame, the legs may tend to remain in the extended position. Further, with the cross bars rigidly and securely attached to the side rails of the frame, the cross bars and the side rails may help provide a torsion resistant configuration to help prevent the table top from undesirably twisting or distorting when an uneven load or force is applied to a portion of the table top.

Another aspect is a table that may include a table frame having a torsion resistant configuration. The torsion resistant table frame may include a one or more side rails and one or more connecting members. The connecting members are preferably rigidly connected to the side rails, which may help provide a torsion resistant configuration. Significantly, the torsion resistant frame may help prevent the table top from undesirably twisting or distorting when an uneven load or force is applied to a portion of the table top.

Yet another aspect is a table that may include a table top constructed from plastic. The table top is preferably constructed using a blow-molding process, which may allow a lightweight table top to be formed and it may allow the table top to have various desired configurations, shapes, sizes and designs. This may also allow a table top to be constructed that is generally weather resistant and temperature insensitive, which may allow the table to be used in a wide variety of locations and environments. In addition, this may allow a table top that is durable, long-lasting and corrosion resistant to be constructed. Further, because a table top constructed from blow-molded plastic may be relatively strong, the table may be used to support a relatively large amount of weight. Advantageously, the blow-molded plastic table top may form a structural member of the table and/or the table top may be supported by a frame or other structures.

Advantageously, the blow-molded plastic table top may be relatively strong because, for example, it may include opposing walls or surfaces that are separated by a distance. The opposing walls are preferably separated by a generally constant distance so that a high-strength, rigid table top with generally uniform characteristics is constructed. In addition, the blow-molded plastic table top may be lightweight because it may include a hollow interior portion that is formed during the blow-molding process. The table top, however, could also be constructed from other suitable processes such as injection molding, rotary molding, compression molding and the like, and the table top could also be constructed from other materials with appropriate characteristics.

Another aspect is a table that may include a table top constructed from blow-molded plastic and including a hollow interior portion that is formed during the blow-molding process. The table may include a frame connected to the table top and the frame may include a first side rail and a second side rail. A first cross bar is preferably connected to the frame proximate a first end of the table top and a first leg assembly may be connected to the first cross bar. A second cross bar is preferably connected to the frame proximate a second end of the table top and a second leg assembly may be connected to the second cross bar. The table may also include a first connecting member connected to the frame proximate the first end of the table top and a second connecting member connected to the frame proximate the second end of the table top.

Yet another aspect is a table that may include a table top and a frame. The frame may include a first generally non-circular opening within one or more engaging portions and a second generally non-circular opening with one or more engaging portions. The table may also include a cross bar with a first portion having a generally non-circular configuration and one or more engaging portions, the first portion of the first cross bar being disposed within the first opening in the frame, and a second portion having a generally non-circular configuration and one or more engaging portions, the second portion of the first cross bar being disposed within the second opening in the frame. The table may also include a leg assembly connected to the cross bar, the leg assembly being movable between a collapsed position and an extended position relative to the table top. Preferably one or more engaging portions of the first portion of the cross bar engage the one or more engaging portions of the first opening in the frame when the leg assembly is in the extended position to securely hold the leg assembly in a generally fixed position. In addition, one or more engaging portions of the second portion of the cross bar engage the one or more engaging portions of the second opening in the frame when the leg assembly is in the extended position to securely hold the leg assembly in a generally fixed position.

Still another aspect is a table that may include a table top and a frame connected to the table top. A pair of openings is preferably formed in the frame and the openings preferably have a generally non-circular configuration. The table may also include a leg assembly that is movable between an extended position and a collapsed position relative to the table top. In addition, the table may include a cross bar with a generally non-circular cross-sectional configuration connecting the leg assembly to the pair of openings in the frame, the cross bar being sized and configured to have one or more gaps between the cross bar and the openings in the frame to allow the cross bar to move within the openings when the leg assembly is in the collapsed position, the cross bar being sized and configured to securely hold the leg assembly in a generally fixed position when the leg assembly is in the extended position. Further, the table may include a connecting member connected to the frame proximate a first end of the table top.

A further aspect is a table that may include a table top and a frame connected to the table top. A pair of openings are preferably formed in the frame and a leg assembly may be movable between an extended position and a collapsed position relative to the table top. The table may also include a cross bar that is inserted into the openings in the frame, the leg assembly being connected to the cross bar, the rotation of the cross bar within the openings moves the leg assembly between the extended position and the collapsed position, the cross bar being loosely held within the openings when the leg assembly is in the collapsed position and the cross bar being securely hold within the openings when the leg assembly is in the extended position. Additionally, the table may include a connecting member connected to the frame proximate a first end of the table top.

These and other aspects, features and advantages of the invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards a table. The principles of the present invention, however, are not limited to a table. It will be understood that, in light of the present disclosure, the invention disclosed herein can be successfully used in connection with other types of furniture, fixtures, and equipment.

Additionally, to assist in the description of the table, words such as top, bottom, front, rear, right and left may be used to describe the accompanying figures. It will be appreciated, however, that the table can be located in a variety of desired positions—including various angles, sideways and even upside down. A detailed description of the table now follows.

Figure 1:
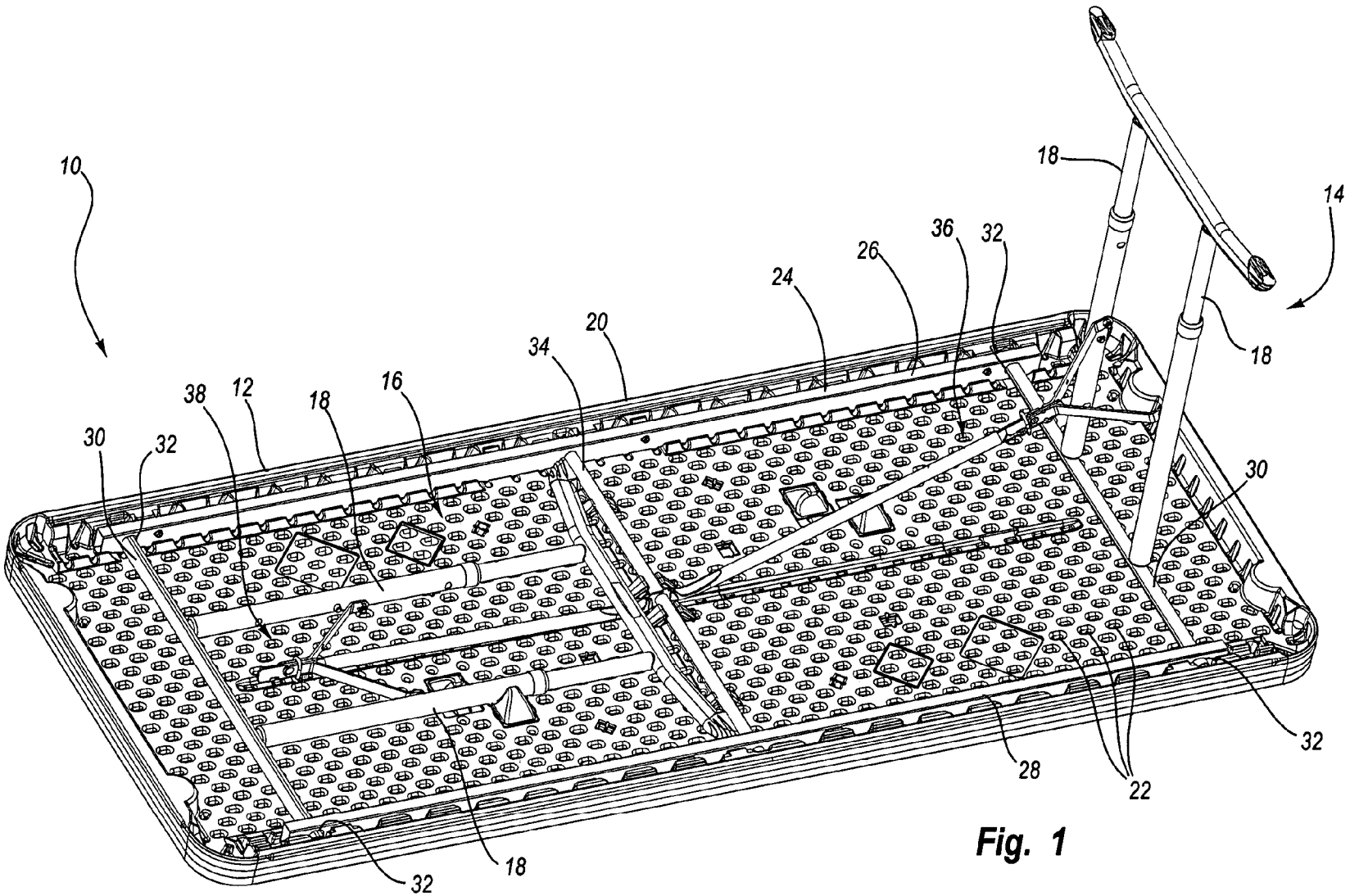
FIG. 1 is a bottom perspective view of an exemplary embodiment of a table, illustrating one leg assembly in an extended position and another leg assembly in a collapsed position.
Figure 2:
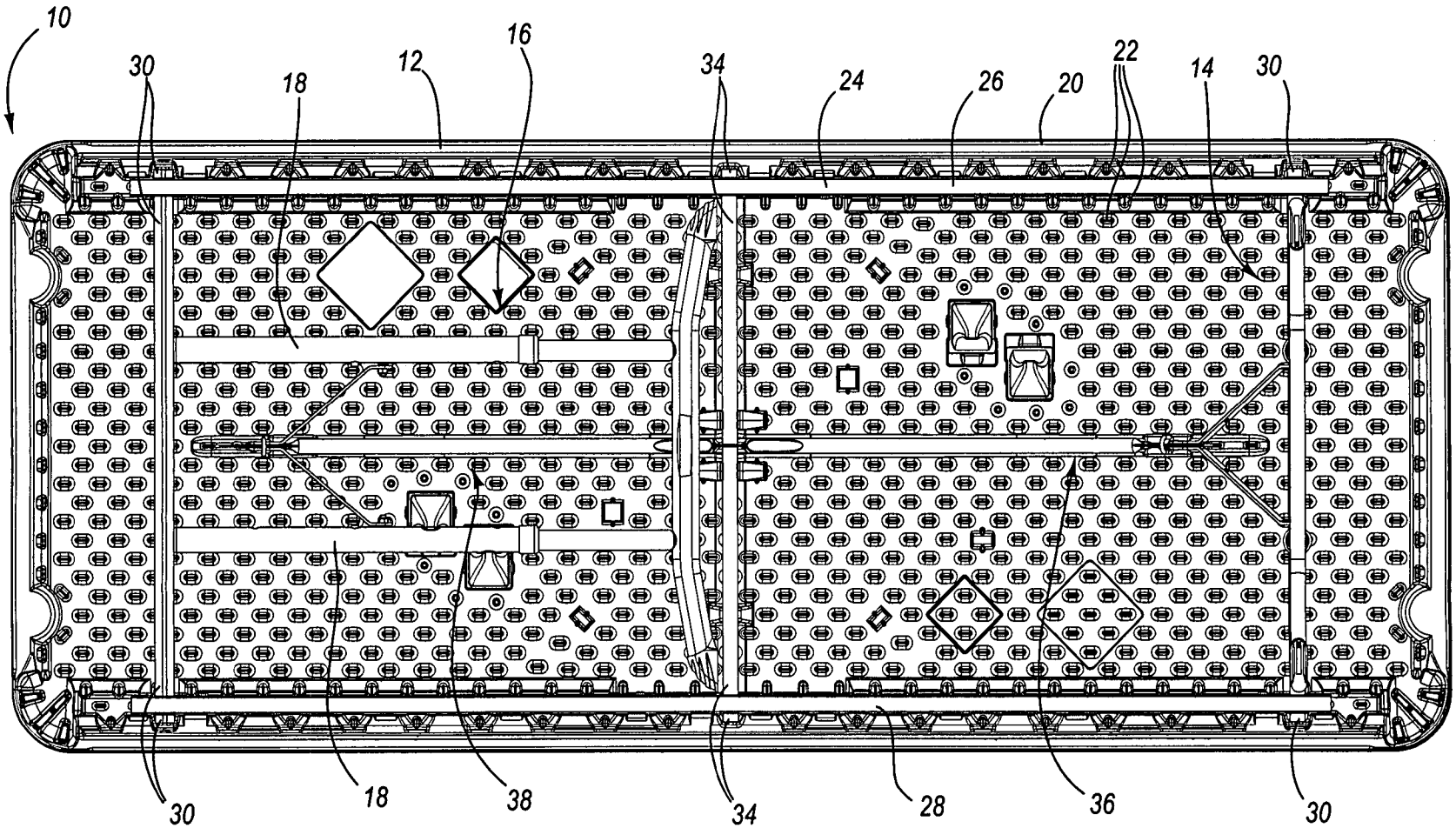
FIG. 2 is a bottom view of the table shown in FIG. 1.

As shown in FIGS. 1-2, an exemplary embodiment of a table 10 includes a table top 12 with a first leg assembly 14 and a second leg assembly 16 that may be used to support the table top above a surface such as the floor. The first and second leg assemblies 14, 16 may include one or more legs 18. For example, as shown in the accompanying figures, the first and second leg assembles 14, 16 could include two legs 18 that are interconnected. The leg assemblies 14, 16 could also include only a single leg 18, if desired. In addition, the leg assemblies 14, 16 could include any suitable number and configuration of legs 18, and the leg assemblies may include other suitable parts and components depending, for example, upon the design of the leg assemblies. Thus, for example, the leg assemblies 14, 16 may consist of only a single leg 18 or the leg assemblies may include one or more legs and other parts or components such as connecting members, feet, and the like. One of ordinary skill in the art will appreciate that the leg assemblies 14, 16 and legs 18 may have a variety of suitable shapes and sizes, and the leg assemblies and/or legs may have a fixed or adjustable length.

As shown in the accompanying figures, the leg assemblies 14, 16 are preferably movable between a collapsed position and an extended position relative to the table top 12. For example, as shown in FIGS. 1-2, the first leg assembly 14 is in the extended position in which the leg assembly extends outwardly from the table top 12, and the second leg assembly 16 is in the collapsed position in which the leg assembly is generally adjacent and parallel to the lower portion of the table top. When the leg assemblies 14, 16 are in the collapsed position, all or a portion of the leg assemblies may contact or abut the lower portion of the table top 12, if desired. Advantageously, this may facilitate shipping and/or stacking of the tables 10. As discussed in greater detail below, the leg assemblies 14, 16 may be pivotally connected to the table top 12, but the leg assemblies may be connected to the table top in any suitable manner.

As shown in FIGS. 1-2, the table top 12 may have a generally rectangular shape. For example, the table top 12 may have a length of about 72 inches (about 1.8 meters) and a width of about 30 inches (about 0.76 meters). Advantageously, this size of table top 12 may be used to form a utility-type table, which may allow the table 10 to be used for a wide variety of purposes and reasons. One of ordinary skill in the art will understand that the table top 12 could also be larger or smaller depending, for example, upon the intended use of the table 10. The table top 12 could also have other suitable configurations such as a generally circular configuration with a diameter of about 30 inches (about 0.76 meters) or a generally square configuration with about 30-inch (about 0.76 meters) sides. The table 10 may include a relatively small table top 12 that is sized and configured for use by an individual. On the other hand, if the table 10 is intended to be used by more than one person, then the table top 12 may have a larger size. Significantly, the table top 12 may be sized and configured for numerous suitable particular purposes and functions, such as a personal table, computer table, game table, bedside table, night stand, television table, utility table, card table, conference table and the like. While the table 10 may be sized and configured for a particular use or activity, the table could also have a general shape, design and/or configuration to allow it to be used in a variety of situations and circumstances.

The table top 12 is preferably constructed from a lightweight material and, more preferably, the table top is constructed from plastic, such as high density polyethylene. The plastic table top 12 is desirably formed by a blow-molding process because, for example, the blow-molding process may allow a strong, lightweight, rigid and sturdy table top to be quickly and easily manufactured. Advantageously, a blow-molded plastic table top 12 may have a lighter weight than a conventional table top, which may allow the table 10 to be more easily moved, transported and stored. The blow-molded plastic table top 12 may also be constructed from less plastic than a conventional plastic table top, and that may reduce manufacturing expenses and consumer costs. In addition, the blow-molded plastic table top 12 may be constructed with thinner outer walls and that may allow the table top to cool more quickly during the manufacturing process. This may decrease the time required to create the table top 12 and may increase the efficiency in which the table 10 is manufactured.

The blow-molded plastic table top 12 may be lightweight because it may include a hollow interior portion that is formed during the blow-molding process. Advantageously, the lightweight table top 12 may allow a lighter weight table 10 to be constructed. The lighter weight table 10 may reduce shipping costs and may allow the consumer to more easily move the table. One of ordinary skill in the art will appreciate that the hollow interior portion formed during the manufacturing process may be subsequently filled with material, such as foam, and that the table top 12 does not have to be formed with a hollow interior portion.

The table top 12 is preferably constructed from blow-molded plastic because blow-molded plastic table tops may be relatively durable, weather resistant, temperature insensitive, corrosion resistant and rust resistant. In addition, blow-molded plastic generally does not deteriorate over time and can be used in a wide variety of environments. One skilled in the art, however, will appreciate that the table top 12 does not have to be constructed from blow-molded plastic and other suitable materials and/or processes can be used to construct the table top depending, for example, upon the intended use of the table 10. Thus, the table top 12 could be constructed from other materials with suitable characteristics, such as, other plastics, composites, synthetics, wood, plywood, particle board, metal, metal alloys, fiberglass, ceramics and the like. Additionally, the table top 12 could be constructed using other suitable processes such as injection molding, extrusion molding, rotary molding and the like.

The table top 12 may include one or more features such as a generally downwardly extending lip 20. Advantageously, the lip 20 may be integrally formed in the table top as part of a unitary, one-piece structure. The lip 20 may be disposed about the outer portion of the table top 12 or the lip may be disposed inwardly from the outer edge of the table top. The table top 12 may also include one or more recesses that are sized and configured to receive at least a portion of the leg assemblies 14, 16 when the leg assemblies are in the collapsed position. For example, as shown in the accompanying figures, a recess may be at least partially formed by the lower portion of the table top 12 and the lip 20. Advantageously, when the leg assemblies 14, 16 are in the collapsed position, the leg assemblies may be partially or completely disposed within the recess.

As discusses above, when the leg assemblies 14, 16 are in the collapsed position, the leg assemblies are preferably positioned generally adjacent and parallel to a lower portion of the table top 12. In addition, all or a portion of the leg assemblies 14, 16 may contact the lower portion of the table top 12 when the leg assemblies are in the collapsed position. Advantageously, when the leg assemblies 14, 16 are in the collapsed position, the leg assemblies may be sized, configured and positioned so that the leg assemblies do not extend beyond a plane that is generally aligned with a lower portion of the lip 20. The leg assemblies 14, 16 may also be sized, configured and positioned so that the leg assembles are at least substantially disposed within an envelope generally defined by the lower portion of the table top 12, the lip 20 and a plane generally aligned with a lower portion of the lip. Advantageously, these configurations may facilitate stacking of the tables 10, which may allow the tables to be more easily shipped and stored.

In greater detail, as shown in the accompanying figures, the lip 20 is preferably disposed about the outer periphery of the table top 12 and it may be generally i aligned with the outer edge of the table top. In particular, the lip 20 may include an outer portion that is generally aligned with the outer edge of the table top 12, but the lip could be spaced inwardly if desired. The lip 20 may also include a lower portion with a generally even and level surface. Preferably, the lower portion of the lip 20 is generally aligned in the same plane to facilitate stacking of the table 10. In addition, the lip 20 may include a hollow interior portion and the lip may be integrally formed with the table top 12, for example, during the blow-molding process. Advantageously, this may allow the hollow interior portion of the lip 20 to be formed with the hollow interior portion of the table top 12 during the blow-molding process. This may also allow the hollow interior portion of the lip 20 to be in communication with the hollow interior portion of the table top 12. It will be appreciated, however, that the lip 20 does not have to be integrally formed with the table top 12 and the lip could be formed from other suitable processes and materials. It will also be appreciated that the lip 20 could be a separate component that is attached to the table top 12 and the lip could be disposed about all or only a portion of the table top. Further, it will be appreciated that the lip 20 could have a variety of suitable arrangements and configurations, and the table 10 does not require a lip.

The lip 20 could also include an inner portion and it may be spaced apart from the outer portion of the lip. The inner portion of the lip 20 may include a number of serrations, notches, ribs, struts and the like that are sized and configured to increase the strength, rigidity and/or flexibility of the lip 20. In particular, the inner portion of the lip 20 may include a number of notches, indentations, grooves or other inwardly extending portions to form at least a portion of an uneven or saw-tooth type surface. The inner portion of the lip 20 may also include a number of bumps, humps, protrusions or other outwardly extending portions to form at least a portion of an uneven or saw-tooth type surface. The inner portion of the lip 20 may also contain a combination of inwardly and outwardly portions to form at least a portion of the uneven or saw-tooth type surface. These and other suitable configurations of the lip 20, table top 12 and/or table 10 are disclosed in U.S. patent application Ser. No. 10/409,273, which was filed Apr. 8, 2003, entitled EDGE AND CORNER FOR A TABLE TOP, now U.S. Pat. No. 7,111,563; and Assignee's pending U.S. patent application Ser. No. 11/051,933, which was filed on Feb. 4, 2005, entitled EDGE AND CORNER FOR A STRUCTURE CONSTRUCTED FROM BLOW-MOLDED PLASTIC; each of which are incorporated by references in their entirety.

The table top 12 may also include other features such as depressions 22, which are also known as tack-offs or kiss-offs. The depressions 22 may also be integrally formed as part of a unitary one-piece table top 12, such as during the blow-molding process. As shown in FIGS. 1-2, a plurality of depressions 22 may be disposed in the lower surface of the table top 12. The depressions 22 preferably cover at least a substantial portion of the lower surface of the table top 12 and the depressions preferably extend towards and/or contact an opposing surface, such as the upper surface of the table top. For example, depressions 22 may be formed in the lower portion of the table top 12 and the ends of the depressions may contact or abut the inner surface of the upper portion of table top 12 or the ends of the depressions may be spaced from the upper portion of the table top. The depressions 22 may also be formed in a predetermined pattern or array, and the depressions may be placed in a staggered, geometric, random or suitable arrangement. One of ordinary skill in the art will appreciate that the depressions 22 may be formed in any desired portions of the table top 12.

Advantageously, the depressions 22 may be sized and configured to increase the strength and/or structural integrity of the table top 12. For example, it was previously believed that stronger blow-molded plastic structures were created by increasing the thickness of the outer walls and/or adding reinforcement structures such as troughs or ribs. Increasing the number of depressions in a blow-molded plastic structure, however, created the surprising and unexpected result of a stronger structure. In addition, increasing the number of depressions created the surprising and unexpected result that the thickness of the outer walls may be reduced, which may allow a structure to be constructed with less plastic. Surprisingly, increasing the number of depressions increased the strength and structural integrity of the structure despite forming additional disruptions and discontinuities in the structure. These surprising and unexpected results allow the table top 12 to be constructed with less plastic even though the lower surface of the table top includes a greater number of disruptions and discontinuities created by the depressions 22. Additionally, the increased number of depressions 22 may increase the strength and/or structural integrity of the table top 12. Accordingly, less plastic may be used to make the table top 12 by increasing the number of depressions 22, which may create a lighter weight table 10.

Additionally, the depressions 22 may reduce the amount of time required to manufacture the table top 12. For example, when a blow-molded structure such as the table top 12 formed, a certain amount of time must elapse before the structure can be removed from the mold. Advantageously, blow-molded structures with thinner walls have a shorter cooling time than structures with thicker walls. Thus, the depressions 22 may allow table tops 12 with thinner plastic walls to be constructed and the cooling time required before the table tops can be removed from the mold may be decreased. Significantly, a reduced cycle time may increase the efficiency of manufacturing process and decrease the cost of the table 10.

Additional details regarding the size, shape and configuration of depressions that may suitable for use in connection with the table top 12 are disclosed in U.S. patent application Ser. No. 10/409,000, which was filed Apr. 8, 2003, entitled HIGH-STRENGTH, LIGHTWEIGHT BLOW-MOLDED PLASTIC STRUCTURES, now U.S. Pat. No. 7,069,865; and U.S. patent application Ser. No. 10/963,895, which was filed Oct. 12, 2004, entitled HIGH-STRENGTH, LIGHTWEIGHT BLOW-MOLDED PLASTIC STRUCTURES, now U.S. Pat. No. 7,171,910, which are incorporated by reference in their entireties. One of ordinary skill in the art will appreciate that the depressions 22 may have a variety of suitable sizes, shapes and configurations depending, for example, upon the intended use of the table 10. It will also be appreciated that the table top 12 may include other features and structures, such as reinforcement portions, but the depressions and other features are not required.

As shown in FIGS. 1 and 2, the table top 12 may consist of a single, unitary, one-piece structure. The table top 12, however, could be constructed from any suitable number of sections to form, for example, a fold-in-half table. Advantageously, this may allow the table top 12 to be moved between a folded position and an unfolded position, which may facilitate transportation and storage of the table 10. Of course, the table top 12 may be constructed with any suitable number of components or sections depending, for example, upon the intended use of the table 10.

The table 10 may also include a frame 24 which is connected to the table top 12. The frame 24 may be sized and configured to increase the strength and/or rigidity of the table top 12 or the frame may simply allow, for example, the leg assembles 14, 16 to be attached to the table 10. In greater detail, as shown in FIGS. 1-2, the frame 24 may include a first side rail 26 and a second side rail 28. The first and second side rails 26, 28 are preferably disposed proximate the outer edges of the table top 12 and the side rails may extend along all or a portion of the length of the table top. In particular, the side rails 26, 28 preferably extend along at least half of the length of the table top 12; however, the side rails could be longer or shorter. As shown in the accompanying figures, the side rails 26, 28 may be connected to and/or disposed adjacent to the lip 20. It will be appreciated that the side rails 26, 28 could have a generally S-shaped, U-shaped, circular, oval, planar, or other suitable configurations; and the side rails could be connected to any desired portions of the table top 12. It will also be appreciated that the frame 24 could have other suitable components, configurations and the like.

The frame 24 is desirably constructed from metal, which may easily be formed into the desired configuration by known operations, such as stamping and bending, and the metal may be coated or painted as desired. The frame 24 may be connected to the table top 12 using one or more suitable fasteners, such as rivets, bolts or screws, adhesives and the like. Further, the side rails 26, 28 may be attached to the table top 12 using a snap fit, an interference fit, a friction fit and the like. The frame 24 may also be attached to the table top 12 without mechanical fasteners, such as disclosed in U.S. patent application Ser. No. 10/409,259, which was filed on Apr. 8, 2003, entitled FRAME THAT CAN BE ATTACHED TO A TABLE TOP WITHOUT MECHANICAL FASTENERS, now U.S. Pat. No. 7,178,471, which is incorporated by reference in its entirety. It will be appreciated that while the frame 24 and side rails 26, 28 may have a variety of suitable sizes, shapes and configurations, neither the frame nor the side rails are required.

The table 10 may also include one or more cross bars 30 that are disposed proximate the ends of the table top 12. For example, the table 10 may include a first cross bar 30 that is disposed proximate one end of the table top 12 and a second cross bar that is disposed proximate the other end of the table top. The cross bars 30 may be attached to the side rails 26, 28 of the frame 24 and the cross bars may rotate relative to the table top 12. In particular, the ends of the cross bars 30 may be inserted into openings in the side rails 24, 26 of the frame 24 and this may allow the cross bars to rotate relative to the table top 12. The leg assemblies 14, 16 may be attached to the cross bars 30 and/or the cross bars may form a portion of the leg assemblies. Advantageously, the cross bars 30 may help facilitate movement of the leg assemblies 14, 16 between the extended and collapsed positions, but this is not required. It will be appreciated that the cross bars 30 may be connected to any suitable portion of the table 10 and the cross bars do not have to rotate relative to the table top 12. It will also be appreciated that the table 10 could have any suitable number, configuration and/or arrangement of cross bars 30, but cross bars are not required.

Preferably, the cross bars 30 are connected to the side rails 26, 28 of the frame 24 to create a torsion resistant configuration. In particular, if the leg assemblies 14, 16 are connected to the cross bars 30 and the cross bars can be securely or loosely attached to the frame 24, then the leg assemblies may also be securely or loosely attached to the frame. Desirably, the leg assemblies 14, 16 are loosely attached to the frame 24 when the leg assemblies are in the collapsed position and the leg assemblies are securely attached to the frame when the leg assemblies are in the extended position. It will be appreciated that the leg assemblies 14, 16, frame 24 and cross bars 30 could have other suitable configurations and arrangements, if desired.

Figure 3:
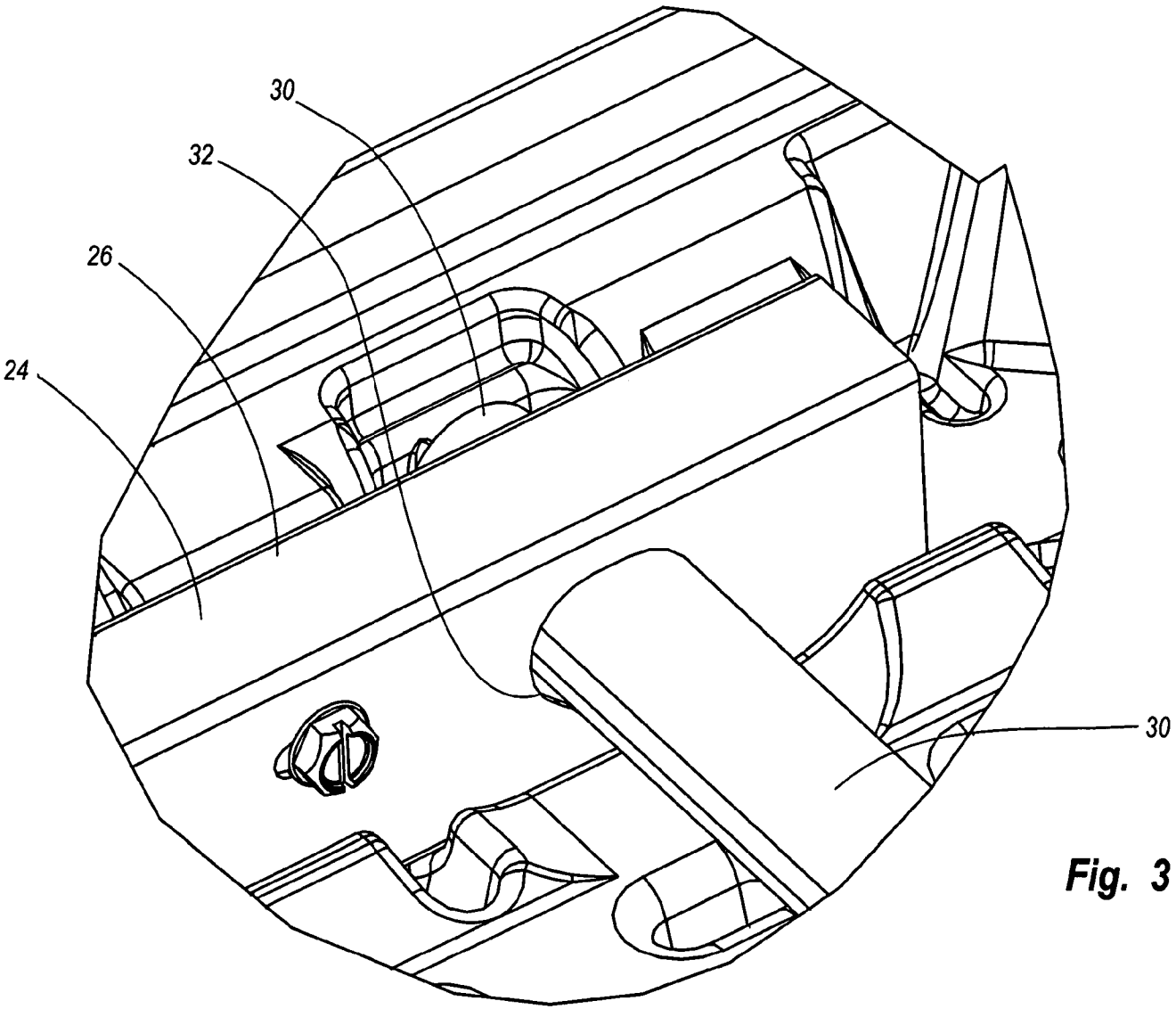
FIG. 3 is an enlarged perspective view of a portion of the table shown in FIG. 1, illustrating the connection of a cross bar to the frame.

In greater detail, as shown in FIGS. 1-3, a first portion of the cross bar 30 may be inserted into one or more openings 32 formed in the first side rail 26 of the frame 24, and a second portion of the cross bar may be inserted into one or more openings 32 formed in the second side rail 28 of the frame 24. The openings 32 in the side rails 26, 28 may be generally aligned in opposing portions of the side rails and the openings may have the same general configuration. It will be appreciated, however, the openings 32 may other suitable configurations and the openings may be positioned in any desired portion of the frame 24.

Desirably, the cross-sectional configuration of the cross bar 30 and the configurations of the openings 32 are sized and configured such that the cross bar is loosely held within the openings when the leg assemblies 14, 16 are in the collapsed position. Thus, when the leg assemblies 14, 16 are in the collapsed position, one or more small gaps or spaces are located between the cross bars 30 and the openings 32 so that the cross bars can move slightly or there is some slack between the cross bar the openings. Advantageously, this may allow the leg assemblies 14, 16 to be more easily connected to the side rails 26, 28 because of the larger clearance.

Additionally, because there may be some movement or "play" between the cross bars 30 and the side rails 26, 28 when the leg assemblies 14, 16 are in the collapsed position, the movement of the cross bars may allow the leg assemblies to fold flatter such that the leg assemblies contact and/or are generally parallel to the lower portion of the table top 12. Further, the movement of the cross bars 30 within the openings 32 may allow the leg assemblies 14, 16 to be positioned in the desired collapsed position even if, for example, there is some slight imperfection in the table 10, if the table has expanded or contracted due to temperature changes, and the like. Accordingly, the tables 10 may be more easily manufactured and assembled because of the greater tolerances, and the tables may fold flatter to facilitate stacking of the tables.

When the leg assemblies 14, 16 are in the extended position, the cross bars 30 are preferably securely held within the openings 32 to rigidly and securely attach the leg assemblies to the frame 24. In particular, with the cross bars 30 rotated within the openings 32 to position the leg assemblies 14, 16 in the extended position, the cross bars and the openings are sized and configured such that there is no or very little movement or play between the cross bars and the openings. Consequently, the leg assemblies 14, 16 preferably do not shake or wobble. In addition, the leg assemblies 14, 16 preferably tend to remain in the extended position. Further, with the cross bars 30 rigidly and securely attached to the side rails 26, 28, the cross bars and the side rails may provide a torsion resistant configuration to help prevent the table top 12 from undesirably twisting or distorting when an uneven load or force is applied to a portion of the table top.

Additionally, because the cross bars 30 may be rigidly and securely attached to the side rails 26, 28 when the legs assemblies 14, 16 are in the extended position, the side rails need not extend along the entire length of the table top 12 to stabilize the table top. Accordingly, the side rails 26, 28 may extend along only a portion of the length of the table top 12. For example, as best seen in FIG. 2, each end of each side rail 26, 28 may be spaced apart from opposing sides or ends of the table top 12. Because the side rails 26, 28 may have a shorter length, the cost of the side rails may be reduced. In addition, this may help conserve resources and allow the same sized side rails 26, 28 to be used with different sized tables 10. Of course, the side rails 26, 28 may extend along all or only a portion of the entire length of the table top 12 depending, for example, upon the intended use of the table 10.

In one exemplary embodiment, the openings 32 in the side rails 26, 28 may have a height of about 15/16 inches (about 2.4 centimeters) and an overall length of about 1.5 inches (about 3.8 centimeters), and the cross bars 30 may have a generally oval configuration with a height of about 15/16 inches (about 2.4 centimeters) and a width of about 0.75 inches (about 1.9 centimeters). Advantageously, these sizes and configurations allow the cross bars 30 to be relatively easily inserted into the openings 32 and the cross bars can move slightly within the openings when the leg assemblies 14, 16 are in the collapsed position. In particular, the cross bars 30 can move within the openings 32 because there are gaps or spaces between the cross bars and the openings. On the other hand, when the leg assemblies 14, 16 are in the extended position, the cross bars 30 are securely held within the openings 32. For example, to help securely hold the cross bars 30 within the openings 32 when the leg assemblies 14, 16 are in the extended position, the upper portion of the cross bars may engage the upper portion of the openings and the lower portion of the cross bars may engage the lower portion of the openings. The engagement of the upper and lower portions of the cross bars 30 and the openings 32 may form a friction or interference fit.

In another exemplary embodiment, the cross bars 30 may have a non-circular cross-sectional configuration, such as oval, oblong, egg-shaped, kidney-shaped, key-shaped, etc. The non-circular cross-sectional configuration of the cross bars 30 may create one or more engaging portions. The engaging portions of the cross bars 30 are preferably sized and configured to engage at least a portion of the openings 32 in the side rails 26, 28 when the leg assemblies 14, 16 are in the extended position. The engaging portions of the cross bars 30 are also preferably sized and configured to at least partially disengage the openings 32 in the side rails 26, 28 when the leg assemblies 14,16 are in the collapsed position.

The openings 32 in the side rails 26, 28 also preferably have a non-circular configuration to create one or more engaging portions. For example, the openings 32 could have a non-circular configuration such as oval, oblong, egg-shaped, kidney-shaped, key-shaped and the like. The generally inward extending portions of the openings 32, for example, may create the engaging portions. The engaging portions of the openings 32 are preferably sized and configured to engage the engaging portions of the cross bars 30 when the leg assemblies 14, 16 are in the extended position. The engaging portions of the openings 32 are also preferably sized and configured to disengage the engaging portions of the cross bars 30 when the leg assemblies 14, 16 are in the collapsed position. It will be appreciated that the engaging portions of the openings 32 and the engaging portions of the cross bars 30 may have the same or different configurations and/or orientations depending, for example, upon the particular design of the table 10. Additionally, only the openings 32 or the cross bars 30 may have engaging portions, if desired.

It will be appreciated that the cross bars 30 and the openings 32 can have other suitable sizes and configurations depending, for example, upon the size and/or intended use of the table 10. It will also be appreciated that other suitable combinations of the cross bars 30 and the openings 32 may be used, such as the combination of generally circular openings and non-circular cross bars, or non-circular openings and generally circular cross bars. Additionally, the cross sectional configuration of the ends of the cross bars 30 and the openings 32 in the side rails 26, 28 may be the same or different.

Other suitable arrangements and configurations for attaching the leg assemblies 14, 16 to the table 10 may also be disclosed in U.S. patent application Ser. No. 10/408,917, filed Apr. 8, 2003, entitled PIVOTAL CONNECTION OF A TABLE LEG TO A FRAME, now U.S. Pat. No. 7,100,518, which was previously incorporated by reference in its entirety. In addition, the cross bars 30 could have suitable arrangements and configurations such as shown in U.S. patent application Ser. No. 10/964,096, which was filed on Oct. 13, 2004, entitled TABLE WITH FOLDABLE LEGS, now U.S. Pat. No. 6,915,748, which is incorporated by reference in its entirety.

As shown in FIGS. 1-2, the table 10 may include a cross bar 34 disposed proximate the center of the table top 12. The cross bar 34 may be attached to the side rails 26, 28 of the frame 24, for example, by inserting the ends of the cross bar into openings in the side rails of the frame. In addition, the cross bar 34 may be rotatably or non-rotatably connected to the side rails 26, 28 of the frame 30. It will be appreciated that the cross bar 34 may be connected to any suitable portion of the table 10 and any suitable number, size and configuration of cross bars may be used, such as shown in U.S. patent application Ser. No. 10/964,096, which was filed on Oct. 13, 2004, entitled TABLE WITH FOLDABLE LEGS, now U.S. Pat. No. 6,915,748, which was previously incorporated by reference in its entirety.

The table 10 may also include braces 36, 38 that may be sized and configured to, for example, secure the leg assemblies 14, 16 in the extended position. For example, a first brace 36 may be connected to the first leg assembly 14 and the cross bar 34, and a second brace 38 may be connected to the second leg assembly 16 and the cross bar 34. It will be appreciated that the first and second braces 36, 38 may be connected to the same cross bar 34 or to different cross bars depending, for example, on the particular configuration of the table 10. It will also be appreciated that the braces 36, 38 could also be attached to any suitable portions of the table 10, such as the table top 12 or frame 24, and that any suitable type of braces may be used depending, for example, upon the intended use of the table. It will be appreciated, however, that the braces 36, 38 and cross bar 34 are not required.

Figure 4:
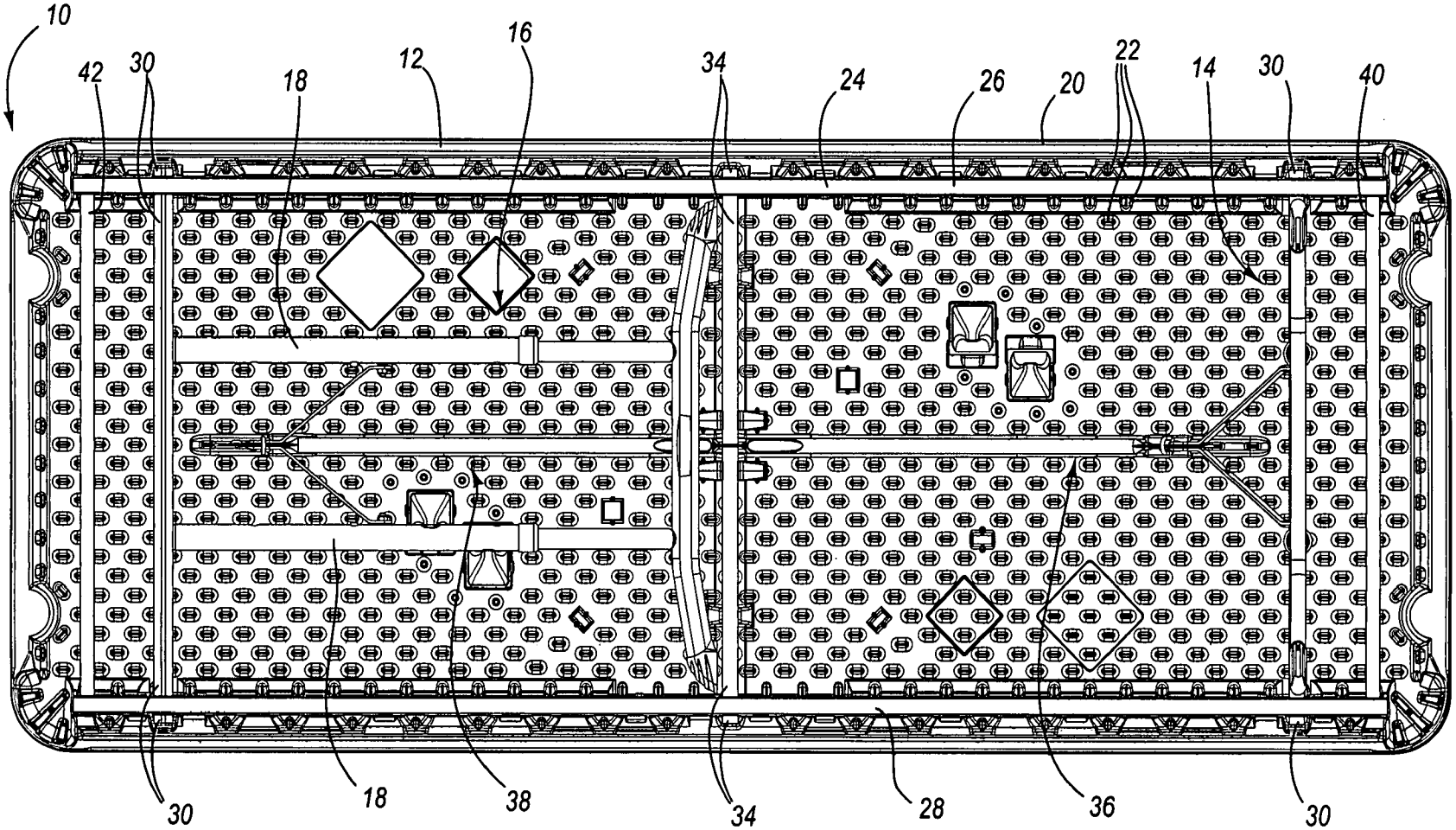
FIG. 4 is a bottom view of another exemplary embodiment of a table, illustrating two cross bars disposed proximate the ends of the table.

As shown in FIG. 4, the table 10 may include one or more connecting members. For example, the table 10 may include a first connecting member 40 that is disposed towards a first end of the table top 12 and a second connecting member 42 that is disposed towards a second end of the table top. The first and second connecting members 40, 42 are preferably connected to the frame 24 or form part of the frame. In particular, the first connecting member 40 may include a first end that is connected to the first side rail 26 of the frame 24 and a second end that is connected to the second side rail 28 of the frame. Likewise, the second connecting member 42 may include a first end that is connected to the first side rail 26 and a second end that is connected to the second side rail 28. While the first and second connecting members 40, 42 are preferably connected to the side rails 26, 28 of the frame 24, the connecting members could also be connected to other suitable portions of the frame, table top 12 and/or table 10. Thus, while the connecting members 40, 42 preferably extend along all or at least a substantial portion of the width of the table top 12 and are connected to the side rails 26, 28 of the frame 24, the connecting members could have any desired length and arrangement depending, for example, the structures that the connecting members are connected.

The first connecting member 40 and the second connecting member 42 are preferably rigidly connected to the side rails 26, 28 of the frame 24 by welding, fasteners, adhesives and the like. It will be appreciated, however, that the first and second connecting members 40, 42 do not have to be rigidly connected to the side rails 26, 28 of the frame 24 and, for example, the connecting members may be selectively or non-permanently attached to the side rails by a snap fit, friction fit, interference fit, fasteners and the like.

The first and the second connecting members 40, 42 are preferably sized and configured to help prevent the table top 12 from bending or twisting. For example, the first and second connecting members 40, 42 may help prevent the table top 12 from being or twisting if a load or force is applied to a portion of the table top. In particular, the first and second connecting members 40, 42 may help prevent the table top 12 from bending or twisting if a load or force is applied to one corner of the table top. Thus, the first and second connecting members 40, 42 may help create a table top 12 that is torsion resistant.

The first and second connecting members 40, 42 are preferably constructed from a relatively strong material such as metal. In particular, the first and second connecting members 40, 42 are preferably constructed from steel and the connecting members preferably have a generally tubular configuration. The first and second connecting members 40, 42 are preferably finished, for example by painting or powder coating, to protect the components from the elements. Advantageously, if the first and second connecting members 40, 42 are constructed from steel tubes, this may help create a table 10 that is strong and able to support a relatively large amount of weight. Preferably, the steel tubes have a generally circular cross-sectional configuration, but the tubes could have any suitable configuration such as elliptical, polygonal, oblong, square, rectangular and the like. The first and second connecting members 40, 42 could also be constructed from other materials with appropriate characteristics and may have other suitable sizes, shapes and configurations, depending, for example, upon the intended purpose or use of the table.

As shown in FIG. 4, the first and second connecting members 40, 42 are preferably connected at or near the ends of the side rails 26, 28 and at or near the ends of the table top 12. Advantageously, in this position, the first and second connecting members 40, 42 may help support the ends of the table top 12. It will be appreciated that the connecting members 40, 42 could be located in any desired positions and any suitable number of connecting members may be used depending, for example, upon the intended use of the table 10. Thus, for instance, additional connecting members may be positioned near the ends or center of the table top 12 if desired.

In greater detail, as shown in FIG. 4, the first and second connecting members 40, 42 are preferably positioned proximate the cross bars 30 disposed near the ends of the table top 12. In particular, the cross bars 30 may be disposed inwardly from the ends of the table top 12 and the first and second connecting members 40, 42 may be positioned towards the ends of the table top. This may allow for greater use of the table 10 because the ends of the table top 12 may be securely supported by the ends of the side rails 26, 28 and the connecting members 40, 42. In addition, because the cross bars 30 may be spaced inwardly from the ends of the table 10, then the leg assemblies 14, 16 may also be spaced inwardly and that may allow, for example, people to sit at the ends of the table. It will be understood that the cross bars 30 may also be disposed towards the ends of the table top 12 and the connecting members 40, 42 may be disposed inwardly from the end of the table top 12. It will also be understood that the cross bars 30 and connecting members 40, 42 may have other suitable configurations and locations depending, for example, upon the intended use of the table 10.

Advantageously, the connecting members 40, 42 and/or cross bars 30 may help create a torsion resistant table 10 because, for example, these components may be securely connecting the side rails 26, 28 the frame 24. In addition, the connecting members 40, 42 and/or cross bars 30 may help create a torsion resistant table 10 by, for example, maintaining the side rails 26, 28 of the frame 24 in a generally parallel configuration and/or preventing the frame from moving if a force or load is applied to the table. The connecting members 40, 42 may also allow the cross bars 30 to be disposed inwardly from the ends of the table top 12 while preventing the ends of the table top from twisting or bending if a force or load is placed on the ends of the table 10. Thus, the connecting members 40, 42 and/or the cross bars 30 may allow the table 10 to have various suitable configurations, and the connecting members and/or cross bars may help create a table top 12 that is torsion resistant.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table comprising:

a table top constructed from blow-molded plastic and including a hollow interior portion that is formed during the blow-molding process, the table top including a first end and a second end;

a frame connected to the table top, the frame comprising: a first side rail including a first end and a second end; and a second side rail including a first end and a second end;

a first cross bar connected to the frame proximate the first end of the table top;

a first leg assembly connected to the first cross bar, the first leg assembly being movable between an extended position and a collapsed position relative to the table top;

a second cross bar connected to the frame proximate the second end of the table top;

a second leg assembly connected to the second cross bar, the second leg assembly being movable between an extended position and a collapsed position relative to the table top;

a first connecting member connected to the frame proximate the first end of the table top; and a second connecting member connected to the frame proximate the second end of the table top.

2. The table as in claim 1, further comprising:

a first opening in the first side rail that receives an end of the first cross bar and a first opening in the second side rail that receives another end of the first cross bar; and a second opening in the first side rail that receives an end of the second cross bar and a second opening in the second side rail that receives another end of the second cross bar;

wherein the first cross bar is loosely held within the first opening in the first side rail and the first opening in the second side rail when the first leg assembly is in the collapsed position, the first cross bar being securely held within the first opening in the first side rail and the first opening in the second side rail when the first leg assembly is in the extended position; and wherein the second cross bar is loosely held within the second opening in the first side rail and the second opening in the second side rail when the second leg assembly is in the collapsed position, the second cross bar being securely held within the second opening in the first side rail and the second opening in the second side rail when the second leg assembly is in the extended position.

3. The table as in claim 1, wherein the first leg assembly is generally disposed between the first side rail and the second side rail in the collapsed position, the first leg assembly is generally disposed between the first connecting member and the second connecting member in the collapsed position, and the first leg assembly is generally disposed between a lower surface of the table top and a lower portion of the frame in the collapsed position; and wherein the second leg assembly is generally disposed between the first side rail and the second side rail in the collapsed position, the second leg assembly is generally disposed between the first connecting member and the second connecting member in the collapsed position, and the second leg assembly is generally disposed between a lower surface of the table top and a lower portion of the frame in the collapsed position.

4. The table as in claim 1, further comprising:

a first opening in the first side rail that receives an end of the first cross bar and a first opening in the second side rail that receives another end of the first cross bar; and a second opening in the first side rail that receives an end of the second cross bar and a second opening in the second side rail that receives another end of the second cross bar;

wherein the first opening in the first side rail has a generally non-circular configuration and the first opening in the second side rail has a generally non-circular configuration;

wherein the second opening in the first side rail has a generally non-circular configuration and the second opening in the second side rail has a generally non-circular configuration;

wherein the first cross bar is loosely held within the first opening in the first side rail and the first opening in the second side rail when the first leg assembly is in the collapsed position, the first cross bar being securely held within the first opening in the first side rail and the first opening in the second side rail when the first leg assembly is in the extended position; and wherein the second cross bar is loosely held within the second opening in the first side rail and the second opening in the second side rail when the second leg assembly is in the collapsed position, the second cross bar being securely held within the second opening in the first side rail and the second opening in the second side rail when the second leg assembly is in the extended position.

5. The table as in claim 1, wherein a first end of the first cross bar has a generally non-circular configuration and a second end of the first cross bar has a generally non-circular configuration;

wherein a first end of the second cross bar has a generally non-circular configuration and a second end of the second cross bar has a generally non-circular configuration;

wherein the first cross bar is loosely held within a first opening in the first side rail and a first opening in the second side rail when the first leg assembly is in the collapsed position, the first cross bar being securely held within the first opening in the first side rail and the first opening in the second side rail when the first leg assembly is in the extended position; and wherein the second cross bar is loosely held within a second opening in the first side rail and a second opening in the second side rail when the second leg assembly is in the collapsed position, the second cross bar being securely held within the second opening in the first side rail and the second opening in the second side rail when the second leg assembly is in the extended position.

6. The table as in claim 1, further comprising:

a first opening in the first side rail that receives an end of the first cross bar, the first opening in the first side rail having a generally non-circular configuration;

a first opening in the second side rail that receives another end of the first cross bar, the first opening in the second side rail having a generally non-circular configuration;

a second opening in the first side rail that receives an end of the second cross bar, the second opening in the first side rail having a generally non-circular configuration;

a second opening in the second side rail that receives another end of the second cross bar, the second opening in the second side rail having a generally non-circular configuration;

a first end of the first cross bar having a generally non-circular configuration and a second end of the first cross bar having a generally non-circular configuration;

a first end of the second cross bar having a generally non-circular configuration and a second end of the second cross bar having a generally non-circular configuration;

wherein the first cross bar is loosely held within the first opening in the first side rail and the first opening in the second side rail when the first leg assembly is in the collapsed position, the first cross bar being securely held within the first opening in the first side rail and the first opening in the second side rail when the first leg assembly is in the extended position; and wherein the second cross bar is loosely held within the second opening in the first side rail and the second opening in the second side rail when the second leg assembly is in the collapsed position, the second cross bar being securely held within the second opening in the first side rail and the second opening in the second side rail when the second leg assembly is in the extended position.

7. The table as in claim 1, wherein the first cross bar has a cross-sectional configuration that is different than the configuration of a first opening in the first side rail that is sized and configured to receive an end of the first cross bar and the configuration of a first opening in the second side rail that is sized and configured to receive another end of the first cross bar; and wherein the second cross bar has a cross-sectional configuration that is different than the configuration of a second opening in the first side rail that is sized and configured to receive an end of the second cross bar and the configuration of a second opening in the second side rail that is sized and configured to receive another end of the second cross bar.

8. A table comprising:

a table top including a first side, a second side, a first end and a second end;

a frame connected to the table top, the frame including a first portion disposed towards the first side of the table top and a second portion disposed towards the second side of the table top;

a first opening in the first portion of the frame, the first opening having a non-circular configuration and being disposed proximate the first end of the table top;

a second opening in the second portion of the frame, the second opening having a non-circular configuration and being disposed proximate the first end of the table top;

a leg assembly movable between an extended position and a collapsed position relative to the table top;

a cross bar including a first end with a non-circular cross-sectional configuration disposed within the first opening in the frame and a second end with a non-circular cross-section configuration disposed in the second opening in the frame, the leg assembly being connected to the cross bar, the cross bar being sized and configured to have one or more gaps between the cross bar and the openings in the frame to allow the cross bar to move within the openings when the leg assembly is in the collapsed position, the cross bar being sized and configured to securely hold the leg assembly in a generally fixed position when the leg assembly is in the extended position; and a connecting member connected to the frame proximate the first end of the table top, the cross bar and the leg assembly.

9. The table as in claim 8, further comprising a height and a width of the openings in the frame; and further comprising a height and a width of the cross bar, the height of the openings in the frame being generally equal to the height of the cross bar, the width of the openings in the frame being significantly larger than the width of the cross bar.

10. The table as in claim 8, further comprising a height and a width of the openings in the frame, the width of the openings being larger than the height of the openings; and further comprising a height and a width of the cross bar, the height of the cross bar being larger than the width of the cross bar.

11. A table comprising:

a table top;

a frame connected to the table top;

a pair of openings formed in the frame, the pair of openings being disposed towards an end of the table top, the pair of openings having a non-circular configuration;

a leg assembly movable between an extended position and a collapsed position relative to the table top;

a cross bar including a first end with a non-circular cross-sectional configuration that is disposed in an opening of the pair of openings in the frame, the cross bar including a second end with a non-circular cross-sectional configuration that is disposed in the other opening of the pair of openings, the leg assembly being connected to the cross bar, the rotation of the cross bar within the openings moves the leg assembly between the extended position and the collapsed position, the cross bar being loosely held within the openings when the leg assembly is in the collapsed position and the cross bar being securely hold within the openings when the leg assembly is in the extended position; and a connecting member connected to the frame proximate the end of the table top, the connecting member being disposed between the end of the table top and the cross bar.

12. The table as in claim 11, wherein the pair of openings in the frame have a non-circular configuration.

13. The table as in claim 11, wherein the cross bar has a non-circular cross-sectional configuration.

14. The table as in claim 11, further comprising a height and a width of the openings in the frame; and further comprising a height and a width of the cross bar, the height of the openings in the frame being generally equal to the height of the cross bar, the width of the openings in the frame being significantly larger than the width of the cross bar.

15. The table as in claim 11, further comprising a height and a width of the openings in the frame, the width of the openings being larger than the height of the openings; and further comprising a height and a width of the cross bar, the height of the cross bar being larger than the width of the cross bar.

16. A table comprising:

a table top;

a frame connected to the table top, the frame including a first non-circular opening and a second non-circular opening;

a cross bar including a first end with a non-circular configuration that is disposed within the first opening in the frame, the first cross bar including a second end with a non-circular configuration that is disposed within the second opening in the frame;

a leg assembly connected to the cross bar, the leg assembly being movable between a collapsed position and an extended position relative to the table top;

wherein, when the leg assembly is in the extended position, a portion of the first end of the cross bar engages a portion of the first opening in the frame to securely hold the first end of the cross bar in a generally fixed position relative to the frame; and wherein, when the leg assembly is in the extended position, a portion of the second end of the cross bar engages a portion of the second opening in the frame to securely hold the second end of the cross bar in a generally fixed position relative to the frame.

17. The table as in claim 16, wherein, when the leg assembly is in the collapsed position, the portion of the first end of the cross bar is at least partially disengaged from the portion of the first opening in the frame to loosely hold the first end of the cross bar in the first opening; and wherein, when the leg assembly is in the collapsed position, the portion of the second end of the cross bar is at least partially disengaged from the portion of the second opening in the frame to loosely hold the second end of the cross bar in the second opening.

18. The table as in claim 16, wherein the cross bar and the leg assembly are connected to the frame proximate an end of the table top; and wherein a connecting member is connected to the frame proximate the end of the table top.

19. The table as in claim 18, wherein the leg assembly is generally disposed between a first side rail and a second side rail of the frame when the leg assembly is in the collapsed position;

wherein the connecting member is rigidly connected to the first side rail and the second side rail of the frame;

wherein the connecting member is disposed between the cross bar and the end of the table top; and wherein the leg assembly is generally disposed between a lower surface of the table top and a lower portion of the frame when the leg assembly is in the collapsed position.

20. The table as in claim 16, wherein the cross bar has a cross-sectional configuration that is different than the configuration of the first opening in the frame and the configuration of the second opening in the frame.

* * * * *

UNITED STATES PATENT AND TRADEMARK OFFICE

CERTIFICATE OF CORRECTION

PATENT NO. : 7,428,872 B2
APPLICATION NO. : 11/141528
DATED : September 30, 2008
INVENTOR(S) : Strong et al.

It is certified that error appears in the above-identified patent and that said Letters Patent is hereby corrected as shown below:

Title Page
Item (63) Related U.S. Application Data, change "application No. 11/141,528, which is" to --application no. 11/141,528 is--
Item (60) Related U.S. Application Data, change "2004, provisional application No. 60/371,486, filed on Apr. 9, 2002." to --2004.--
Item (57) Abstract, change "with the legs" to --when the legs--

Column 2
Line 30, change "top." to --tops.--

Column 4
Line 34, change "within" to --with--

Column 5
Line 17, change "hold" to --held--

Column 8
Line 6, change "generally i aligned" to --generally aligned--
Line 52, change "references" to --reference--

Column 9
Line 34, change "formed" to --is formed--

Column 10
Line 50, change "rails 24, 26" to --rails 26, 28--

Column 11
Line 17, change "may other" to --may have other--
Line 28, change "bar the" to --bars and the--
Line 62, change "legs" to --leg--

Column 13
Line 24, change "30" to --24--

UNITED STATES PATENT AND TRADEMARK OFFICE

CERTIFICATE OF CORRECTION

PATENT NO. : 7,428,872 B2
APPLICATION NO. : 11/141528
DATED : September 30, 2008
INVENTOR(S) : Strong et al.

It is certified that error appears in the above-identified patent and that said Letters Patent is hereby corrected as shown below:

Column 14
Line 2, change "depending, for example, the structures that" to --depending, for example, upon the structures to which--
Line 17, change "being" to --bending--

Column 15
Line 10, change "26, 28 the" to --26, 28 of the--

Column 18
Claim 11, line 47, change "moves" to --moving--
Claim 11, line 51, change "hold" to --held--

Signed and Sealed this

Eleventh Day of August, 2009

David J. Kappos

David J. Kappos
*Director of the United States Patent and Trademark Office*